US009370263B2

(12) United States Patent
Horvath

(10) Patent No.: US 9,370,263 B2
(45) Date of Patent: Jun. 21, 2016

(54) CARGO CONTAINER AND METHOD FOR SELLING CONSUMER FIREWORKS UTILIZING THE CARGO CONTAINER

(71) Applicant: Arbor Valley Holdings, LLC, Ann Arbor, MI (US)

(72) Inventor: Robert C. Horvath, Ann Arbor, MI (US)

(73) Assignee: Arbor Valley Holdings, LLC, Ann Arbor, MI (US)

( * ) Notice: Subject to any disclaimer, the term of this patent is extended or adjusted under 35 U.S.C. 154(b) by 0 days.

(21) Appl. No.: 14/295,371

(22) Filed: Jun. 4, 2014

(65) Prior Publication Data

US 2014/0360815 A1 Dec. 11, 2014

Related U.S. Application Data

(60) Provisional application No. 61/831,239, filed on Jun. 5, 2013.

(51) Int. Cl.

| | |
|---|---|
| ***E04H 1/12*** | (2006.01) |
| ***A47F 5/00*** | (2006.01) |
| ***A47F 10/00*** | (2006.01) |
| ***G06Q 30/04*** | (2012.01) |
| *E05G 1/00* | (2006.01) |

(52) U.S. Cl.

CPC ..... *A47F 5/0043* (2013.01); *A47F 10/00* (2013.01); *E04H 1/1205* (2013.01); *E04H 1/1222* (2013.01); *G06Q 30/04* (2013.01); *E04H 2001/1283* (2013.01); *E05G 1/00* (2013.01)

(58) Field of Classification Search

CPC ..... A47F 5/0043; A47F 9/04; B65D 88/12
USPC ..... 186/26, 35, 36, 40, 52, 59; 296/21, 22, 296/24.36

See application file for complete search history.

(56) References Cited

U.S. PATENT DOCUMENTS

| | | | | |
|---|---|---|---|---|
| 1,242,872 | A * | 10/1917 | Saunders | 52/33 |
| 4,724,630 | A * | 2/1988 | Williams | 40/460 |
| 4,915,435 | A * | 4/1990 | Levine | 296/24.38 |
| 2009/0308693 | A1 * | 12/2009 | Johnson, Jr. | 186/52 |
| 2011/0313811 | A1 * | 12/2011 | Urban et al. | 705/7.25 |
| 2013/0001908 | A1 * | 1/2013 | Karppinen | E04H 6/005 280/79.2 |
| 2013/0118948 | A1 * | 5/2013 | Noyes et al. | 206/569 |

* cited by examiner

*Primary Examiner* — Mark Beauchaine
(74) *Attorney, Agent, or Firm* — Buckert Patent & Trademark Law Firm, PC; John F. Buckert

(57) ABSTRACT

A method for selling consumer fireworks is provided. The method includes disposing a cargo container having an outer housing and first and second shelving units at a location. The outer housing defines an interior region with the first and second shelving units disposed on opposite sides of the interior region such that a longitudinally extending aisle is located between the first and second shelving units. The method further includes disposing first and second consumer firework devices on the first and second shelving units, respectively. The method further includes determining a sales price of at least one of the first and second consumer firework devices that were selected by a consumer that entered through a consumer entrance into the interior region to view the firework devices.

5 Claims, 4 Drawing Sheets

CARGO CONTAINER AND METHOD FOR SELLING CONSUMER FIREWORKS UTILIZING THE CARGO CONTAINER

CROSS-REFERENCE TO RELATED APPLICATIONS

This application claims priority to U.S. Provisional Patent Application No. 61/831,239 filed on Jun. 5, 2013, the entire contents of which are hereby incorporated by reference herein.

BACKGROUND

Consumer fireworks have been displayed and sold under tents. A problem with this approach is that the tents are not easily physically secured and theft of the fireworks can occur. Further, weather conditions such as rainstorms can deposit water on the consumer fireworks under the tent which damages and/or degrades the consumer fireworks.

Accordingly, the inventor herein has recognized a need for an improved method of selling consumer fireworks utilizing a cargo container that minimizes and/or eliminates the above-mentioned deficiency.

SUMMARY

A method for selling consumer fireworks in accordance with an exemplary embodiment is provided. The method includes disposing a cargo container at a predetermined location. The cargo container has an outer housing and first and second shelving units. The outer housing defines an interior region with the first and second shelving units being disposed on opposite sides of the interior region such that a longitudinally extending aisle is located between the first and second shelving units in the interior region. The outer housing has a consumer entrance extending therethrough. The method further includes disposing first and second consumer firework devices on the first and second shelving units, respectively. The method further includes determining a sales price of at least one of the first and second consumer firework devices that were selected by a consumer that entered through the consumer entrance into the interior region of the cargo container to view the first and second consumer firework devices. The method further includes selling the at least one of the first and second consumer firework devices selected by the consumer to the consumer for the sales price.

A cargo container in accordance with another exemplary embodiment is provided. The cargo container includes an outer housing having a bottom wall, a top wall, first and second side walls, and a first end wall, defining an interior region. The first side wall has a first consumer entrance extending therethrough. The cargo container further includes first and second shelving units disposed on opposite sides of the interior region such that a longitudinally extending aisle is located between the first and second shelving units in the interior region. An entrance aisle extends from the first consumer entrance to the longitudinally extending aisle in the interior region.

DETAILED DESCRIPTION

Figure 1:
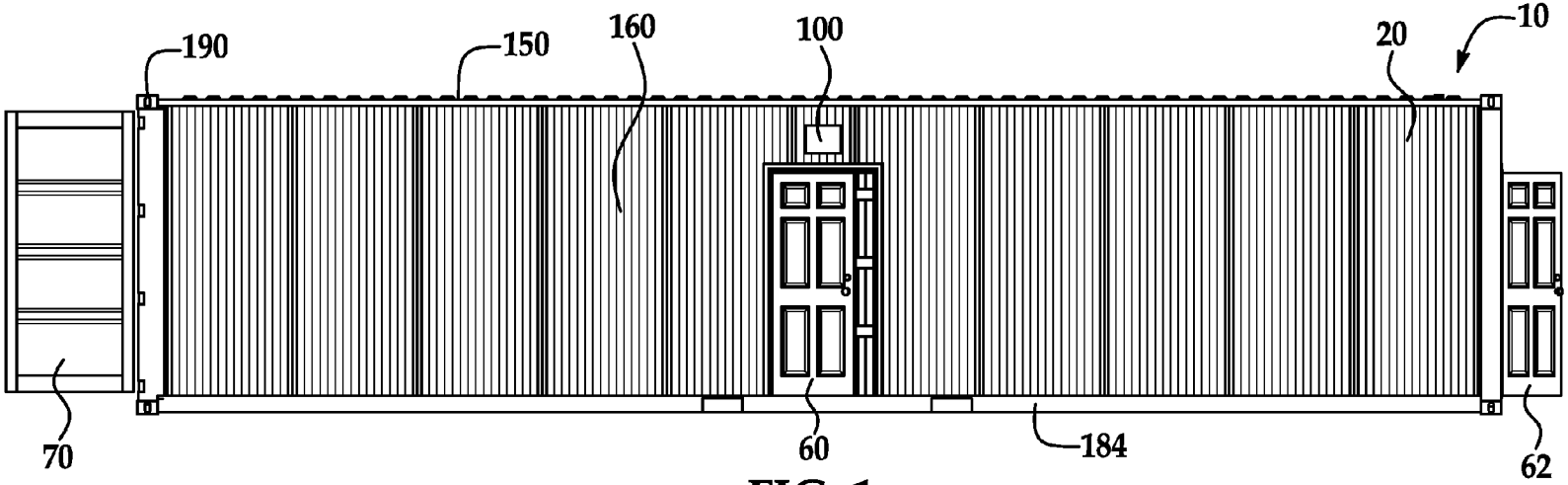
FIG. 1 is a side view of a cargo container in accordance with an exemplary embodiment.

Referring to FIGS. 1-4, a cargo container 10 for selling consumer fireworks, in accordance with an exemplary embodiment is provided. The cargo container 10 includes an outer housing 20, shelving units 30, 32, 34, 36, 40, 42, 44, 46, doors 60, 62, 70, 72, electrical lights 80, 82, 84, exit lights 90, 92, 94, and an entrance sign 100. An advantage of the cargo container 10 is that the container 10 can be transported to multiple locations for selling consumer fireworks at the multiple locations. Another advantage of the cargo container 10 is that the container 10 can securely protect the consumer fireworks stored therein.

A consumer fireworks device is defined as a device for producing a display for entertainment by a combustion of explosive or flammable compositions.

The outer housing 20 defines an interior region 22 for storing the consumer fireworks therein. The outer housing 20 includes a top wall 150, side walls 160, 162, an end wall 170, a bottom wall 184, and support posts 190, 192, 194, 196. In an exemplary embodiment, the outer housing 20 has one of the following dimensions: 19' 4" length×7' 8" width×7' 10" height; 39' 5" length×7' 8" width×7' 10" height; 19' 4" length×7' 7" width×7' 10" height; 39' 5" length×7' 8" width×8' 10" height; 53' length×8' 6" width×9' 6" height. Of course, the outer housing 20 could have other dimensions that allow consumers to readily enter the outer housing 20.

The first and second side walls 160, 162 extend generally parallel to one another. The first side wall 160 has first and second ends coupled to the support posts 190, 194, respectively. The first side wall 160 includes a consumer entrance 200 extending therethrough. The door 60 is operably and rotatably coupled to the first side wall 160 is configured to selectively enclose the consumer entrance 200.

The second side wall 162 includes first and second ends coupled to the support posts 192, 196, respectively. The second side wall 162 has an exhaust port 201 extending therethrough.

The end wall 170 extends generally perpendicular to the first and second side walls 160, 162. The end wall 170 has first and second ends coupled to the support posts 194, 196, respectively. The end wall 170 includes a consumer entrance 202 extending therethrough. The door 62 is operably and rotatably coupled to the end wall 170 and is configured to selectively enclose the consumer entrance 202.

The top wall 150 is coupled to top ends of the first and second side walls 160, 162. The top wall 150 is configured to support the electrical lights 80, 82, 84 within the interior region 22. The electrical lights 80, 82, 84 are configured to illuminate the interior region 22 of the outer housing 20.

The bottom wall 184 is coupled to bottom ends of the first and second side walls 160, 162 and is provided to support the components of the cargo container 10 within the interior region 22.

Another consumer entrance 204 is disposed between the support posts 190, 192 and is defined by the first and second side walls 160, 162, the top wall 150, and the bottom wall 184.

The door 70 is operably and rotatably coupled to the support post 190 and is configured to selectively enclose a portion of the consumer entrance 204. The door 72 is operably and rotatably coupled to the support post 192 and is configured to selectively enclose a portion of the consumer entrance 204.

Figure 2:
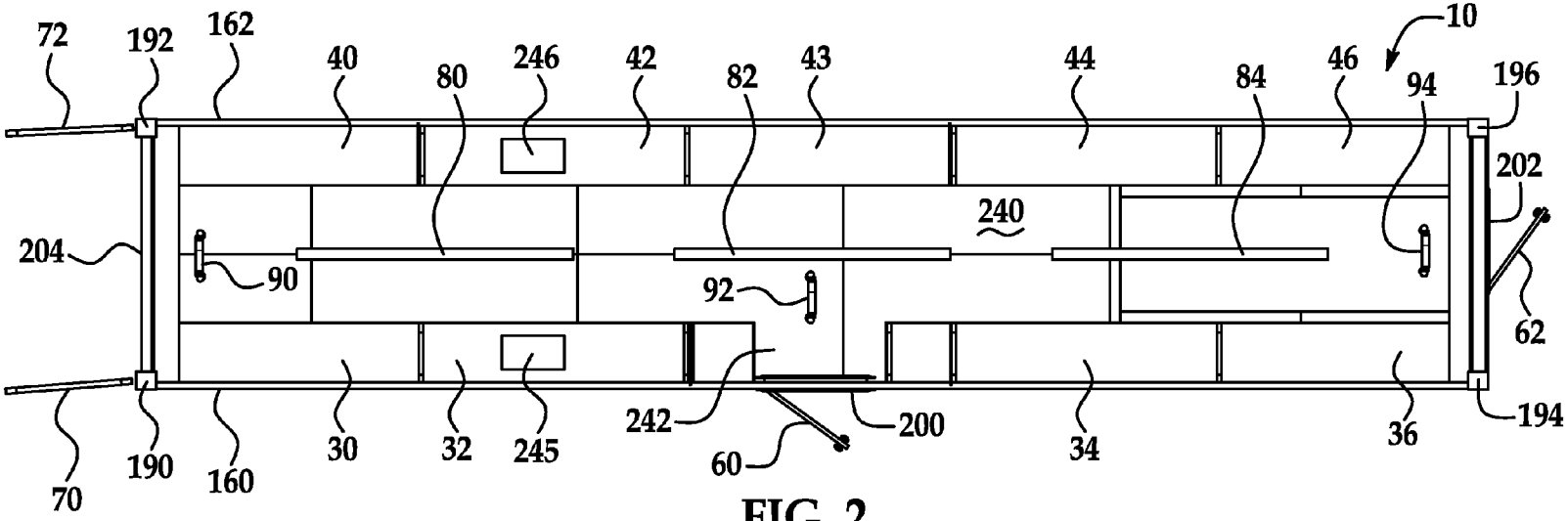
FIG. 2 is a top view of the cargo container of FIG. 1 with a top wall removed therefrom.
Figure 3:
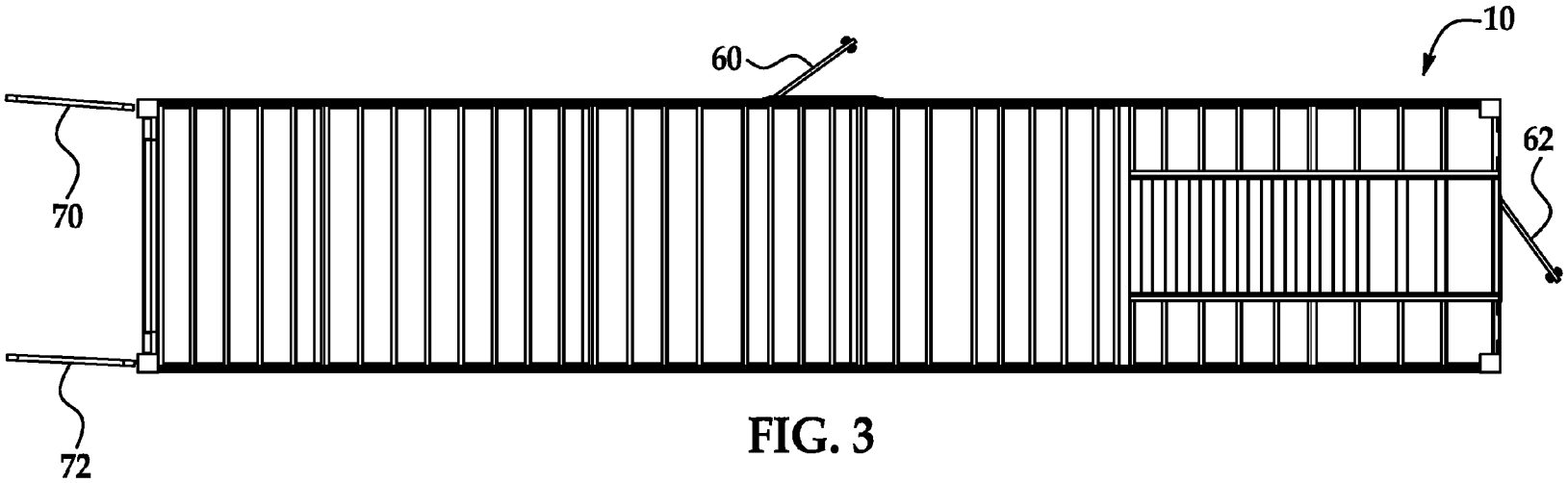
FIG. 3 is bottom view of the cargo container of FIG. 1 with a portion of the bottom wall removed therefrom.
Figure 4:
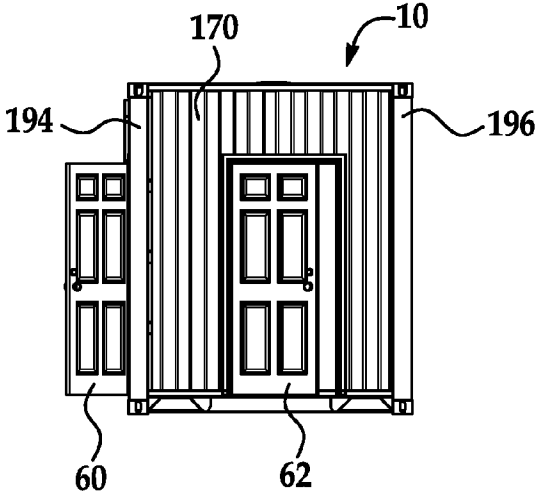
FIG. 4 is an end view of the cargo container of FIG. 1.
Figure 5:
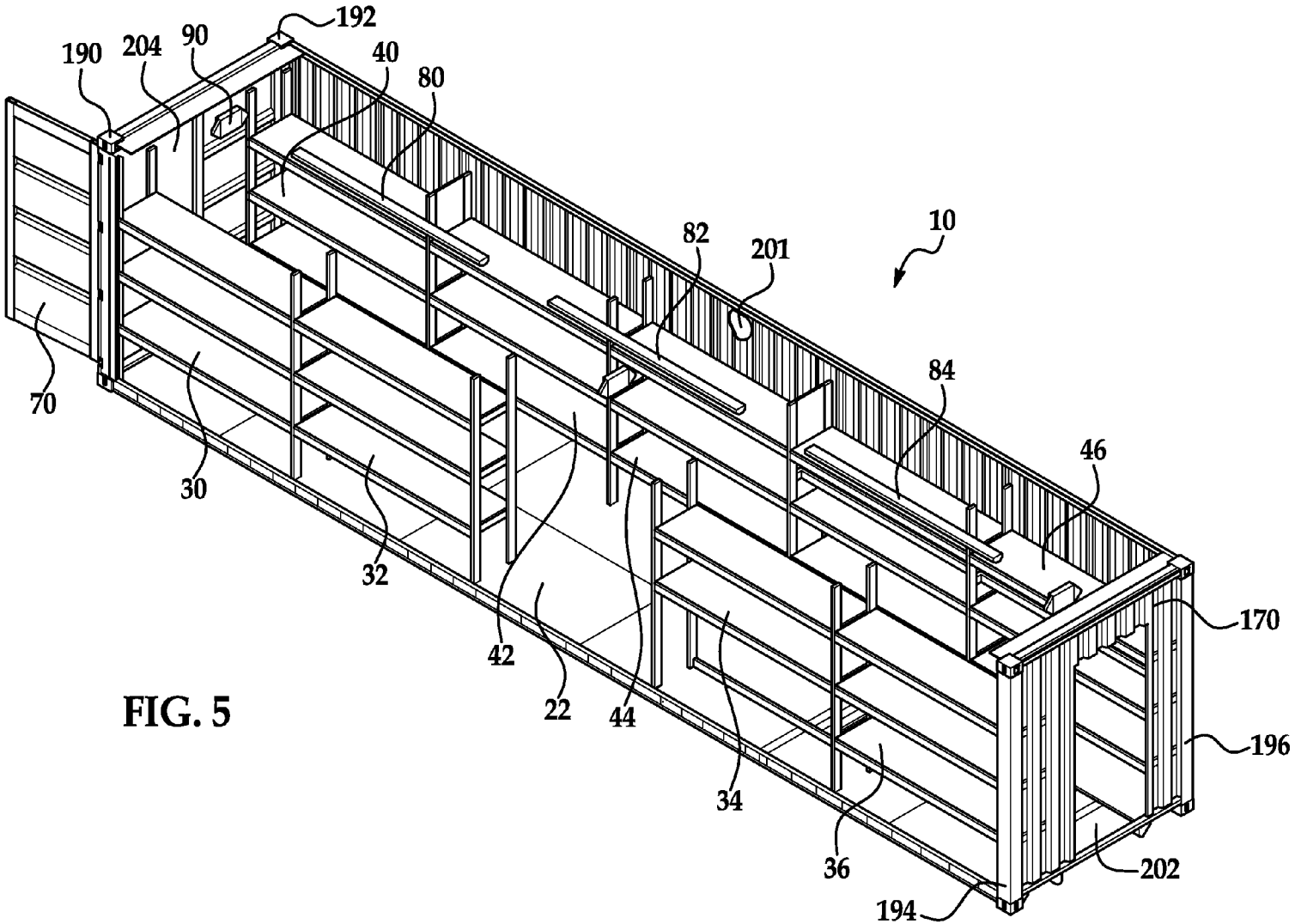
FIG. 5 is an isometric view of a portion of the cargo container of FIG. 1 with a side wall and a top wall removed therefrom.
Figure 6:
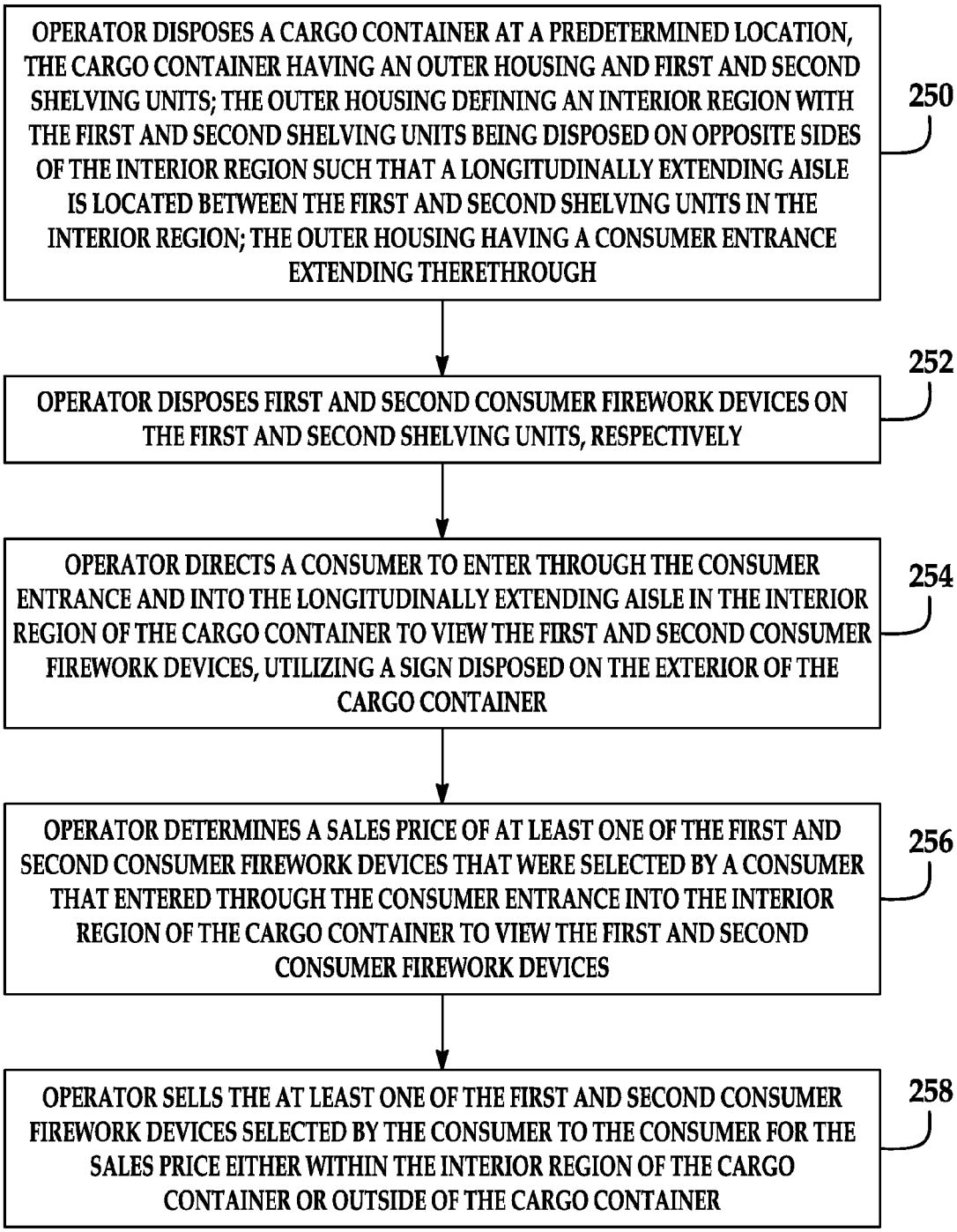
FIG. 6 is a flowchart of a method for selling consumer fireworks in accordance with another exemplary embodiment.

Referring to FIGS. 1, 2, and 5, the shelving units 30-46 are configured to hold consumer fireworks thereon. A first set of shelving units including shelving units 30, 32, 34, 36 are disposed on a first side of the interior region 22 on the bottom wall 184. A second set of shelving units including shelving units 40, 42, 43, 44, 46 are disposed on a second side of the interior region 22 opposite to the first set of shelving units such that a longitudinally extending aisle 240 is located between the first and second sets of shelving units. In one exemplary embodiment, for example, the shelving unit 32 is configured to hold at least a consumer fireworks device 245 thereon. Also, the shelving unit 42 is configured to hold at least a consumer fireworks device 246 thereon. Thus, a consumer walking in the longitudinally extending aisle 240 can view and select the consumer fireworks devices 245, 246 in order to buy the devices 245, 246. In one exemplary embodiment, the longitudinally extending aisle 240 is substantially 4 feet wide and extends substantially an entire longitudinal length of the interior region 22 of the outer housing 20.

In an alternative embodiment, the first set of shelving units 30-36 could be removed from the cargo container 10, or the second set of shelving units 40-46 could be removed from the cargo container 10, such that the longitudinally extending aisle 240 would extend along a longitudinal side of the interior region 22.

The exit light 92 is coupled to the top wall 150 proximate to the consumer entrance 200. Also, the exit light 94 is coupled to the top wall 150 proximate to the consumer entrance 202. Further, the exit light 90 is coupled to the top wall 150 proximate to the consumer entrance 204.

The entrance sign 100 is disposed on an exterior surface of the side wall 160 proximate to the consumer entrance 200. The entrance sign 100 is configured to direct consumers through the consumer entrance 200 into the interior region 22 of the cargo container 10.

Referring to FIGS. 1-6, a flowchart of a method for selling consumer fireworks in accordance with another exemplary embodiment is provided.

At step 250, an operator disposes the cargo container 10 at a predetermined location. The cargo container 10 has the outer housing 20 and the first and second shelving units 32, 42. The outer housing 20 defines an interior region 22 with the first and second shelving units 32, 42 being disposed on opposite sides of the interior region 22 such that a longitudinally extending aisle 240 is located between the first and second shelving units 32, 42 in the interior region 22. The outer housing 20 has the consumer entrance 200 extending therethrough.

At step 252, the operator disposes first and second consumer firework devices 245, 246 on the first and second shelving units 32, 42, respectively.

At step 254, the operator directs a consumer to enter through the consumer entrance 200 and into the longitudinally extending aisle 240 in the interior region 22 of the cargo container 10 to view the first and second consumer firework devices 245, 246, utilizing the entrance sign 100 disposed on the exterior of the cargo container 10. Of course, an alternative embodiment, the consumer could have entered the interior region 22 of the cargo container 10 utilizing the consumer entrance 202 or the consumer entrance 204.

At step 256, the operator determines a sales price of at least one of the first and second consumer firework devices 245, 246 that were selected by the consumer that entered through the consumer entrance 200 into the interior region 22 of the cargo container 10 to view the first and second consumer firework devices 245, 246.

At step 258, the operator sells the at least one of the first and second consumer firework devices 245, 246 selected by the consumer to the consumer for the sales price either within the interior region 22 of the cargo container 10 or outside of the cargo container 10.

The method for selling consumer fireworks utilizing a cargo container 10 provides a substantial advantage over other methods and structures. In particular, the method utilizes a portable cargo container having fireworks stored therein that can be transported to multiple locations for conveniently selling consumer fireworks at the multiple locations over a relatively short time period. Another advantage of the method is that a user can enter the interior region of the cargo container and walk along a longitudinally extending aisle to view and select consumer firework devices disposed on shelving units within the cargo container 10. Another advantage of the cargo container 10 is that the cargo container 10 can be securely locked up during non-business hours to prevent theft of the fireworks.

While the claimed invention has been described in detail in connection with only a limited number of embodiments, it should be readily understood that the invention is not limited to such disclosed embodiments. Rather, the claimed invention can be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description.

What is claimed is:

1. A method for selling consumer fireworks, comprising:

providing a cargo container having an outer housing, first, second, third, and fourth shelving units, and first, second, third, and fourth doors; the outer housing having a bottom wall, a top wall, first and second side walls, and a first end wall, defining an interior region; the outer housing further having a first end and a second end; the first end of the outer housing having a first consumer entrance that is selectively enclosed by the first and second doors, the first end wall being disposed at the second end of the outer housing and extending generally perpendicular to the first and second side walls; the top wall being coupled to top ends of the first and second side walls; the bottom wall being coupled to the bottom ends of the first and second side walls, modifying the outer housing of the cargo container by forming a second consumer Entrance in the first side wall, and mounting the third door on the first side wall to selectively enclose the second consumer entrance;

modifying the outer housing of the cargo container by forming a third consumer entrance in the first end wall, and mounting the fourth door on the first end wall to selectively enclose the third consumer entrance;

disposing the first and third shelving units on a first side of the interior region, and the second and fourth shelving units on a second side of the interior region such that a longitudinally extending aisle is located between the first and second shelving units in the interior region and is further located between the third and the fourth shelving units in the interior region; the first and third shelving units being spaced apart from one another on opposite sides of the second consumer entrance, the first and third shelving units having an entrance aisle therebetween that extends from the second consumer entrance to the longitudinally extending aisle in the interior region, the longitudinally extending aisle extending along an entire length of the interior region and directly communicating with both the first and third consumer entrances located at the first and second ends, respectively, of the outer housing;

disposing the cargo container at a predetermined location;

disposing first and second consumer firework devices on the first and second shelving units, respectively;

allowing a consumer to enter through one of the first, second, and third consumer entrances into the interior region of the cargo container;

allowing the consumer to walk along the entire length of the interior region from the first end of the outer housing of the cargo container to the second end of the outer housing of the cargo container, and to view the first and second consumer firework devices;

determining a sales price of at least one of the first and second consumer firework devices that were selected by the consumer; and selling at least one of the first and second consumer firework devices selected by the consumer to the consumer for the sales price.

2. The method of claim 1, wherein selling at least one of the first and second consumer firework devices comprises:

selling at least one of the first and second consumer firework devices selected by the consumer to the consumer for the sales price within the interior region of the cargo container.

3. The method of claim 1, wherein selling at least one of the first and second consumer firework devices comprises:

selling at least one of the first and second consumer firework devices selected by the consumer to the consumer for the sales price outside of the cargo container.

4. The method of claim 1, further comprising directing the consumer to enter through the first consumer entrance into the interior region of the cargo container to view the first and second consumer firework devices utilizing a sign disposed on the exterior of the cargo container.

5. The method of claim 1, further comprising allowing the consumer to walk on the longitudinally extending aisle between the first and second shelving units in the interior region to view the first and second consumer firework devices.

* * * * *